US009541297B2

(12) United States Patent
Weng et al.

(10) Patent No.: US 9,541,297 B2
(45) Date of Patent: Jan. 10, 2017

(54) HEATING VENTILATOR FOR BATHROOM

(75) Inventors: Yefan Weng, Guangdong (CN); Liang Tian, Guangdong (CN); Hongjian Yuan, Guangdong (CN); Makoto Ishikawa, Aichi (JP)

(73) Assignees: Panasonic Ecology Systems Guangdong Co., Ltd. (CN); Panasonic Corporation (JP)

( * ) Notice: Subject to any disclaimer, the term of this patent is extended or adjusted under 35 U.S.C. 154(b) by 813 days.

(21) Appl. No.: 13/639,177

(22) PCT Filed: Feb. 10, 2011

(86) PCT No.: PCT/CN2011/000208

§ 371 (c)(1),
(2), (4) Date: Nov. 28, 2012

(87) PCT Pub. No.: WO2011/127741

PCT Pub. Date: Oct. 20, 2011

(65) Prior Publication Data

US 2013/0143479 A1 Jun. 6, 2013

(30) Foreign Application Priority Data

Apr. 12, 2010 (CN) ..... 2010 1 0147375

(51) Int. Cl.
*F24F 1/00* (2011.01)
*F24F 7/007* (2006.01)
(Continued)

(52) U.S. Cl.
CPC ..... *F24F 7/007* (2013.01); *F04D 29/422* (2013.01); *F04D 29/4226* (2013.01); *F04D 29/441* (2013.01)

(58) Field of Classification Search
CPC ..... F24F 3/00; F24F 2007/002; F24F 7/007
(Continued)

(56) References Cited

U.S. PATENT DOCUMENTS 2,615,383 A * 10/1952 Jenn ..... 454/233
2,870,319 A * 1/1959 Ford ..... 392/347
(Continued)

FOREIGN PATENT DOCUMENTS

CN 2116109 9/1992
CN 101576095 11/2009
(Continued)

OTHER PUBLICATIONS

International Search Report for International Application No. PCT/CN2011/000208 dated May 19, 2011.
(Continued)

*Primary Examiner* — Avinash Savani
*Assistant Examiner* — Vivek Shirsat
(74) *Attorney, Agent, or Firm* — RatnerPrestia

(57) ABSTRACT

A heating ventilator for bathroom includes a frame, a motor mounted with fan blades, a volute casing, an air path switching plate located at the air outlet of the volute casing for switching the air outlet of a ventilator main body, a heater, and a control electric circuit mechanism for operating the motor, the air path switching plate and the heater. The air path switching plate and the heater are configured in a separate and overlapping manner in the height direction of the ventilator main body. The center line of the fan blades and a tongue of the volute casing are both offset from the center line of the main body and are located at the same side. The center line of the main body is horizontally aligned and overlapped with the center line of the air path switching plate and the center line of the heater.

3 Claims, 4 Drawing Sheets

(51) Int. Cl.
*F04D 29/42* (2006.01)
*F04D 29/44* (2006.01)

(58) Field of Classification Search
USPC ..... 454/349, 354, 233; 392/364, 356
See application file for complete search history.

(56) References Cited

U.S. PATENT DOCUMENTS

2003/0157883 A1* 8/2003 Kwak ..... F24F 11/053
454/258
2009/0275280 A1 11/2009 Liang et al.

FOREIGN PATENT DOCUMENTS

JP 1318832 12/1989
JP 3195848 8/1991
JP 2003 343869 A 12/2003
JP 210014043 1/2010

OTHER PUBLICATIONS

Chinese Office Action with translation issued in related Chinese Application No. 201010147375.2, dated Jul. 23, 2015.

* cited by examiner

190

HEATING VENTILATOR FOR BATHROOM

CROSS-REFERENCE TO RELATED APPLICATION

This application claims the benefit of Chinese Patent Application No. 201010147375.2 filed on Apr. 12, 2010 in the State Intellectual Property Office of China, the disclosure of which is incorporated herein by reference.

BACKGROUND OF THE INVENTION

1. Field of the Invention

The present invention relates to a ventilator, and particularly to a heating ventilator for bathroom.

2. Description of the Related Art

A known heating ventilator 100 for bathroom is shown in FIG. 1. It comprises a frame 110, a motor 130 provided with fan blades 120, a volute casing 140 enclosing the motor 130, a heater (not shown), an air path switching plate 160 and a control electric circuit mechanism 170, etc. Heating, air exchanging and drying are achieved by rotation of the air path switching plate 160.

As shown in FIG. 1, in general, the frame 110 is configured in a rectangle shape, i.e., the ventilator 100 is arranged in the direction from an inner air inlet to an inner warm air outlet 180 as its length direction. Furthermore, an inner warm air outlet 180 and an air discharging outlet 181 for discharging air outside are configured as two air outlets.

In order to achieve discharging air towards the two air outlets, wind path is switched at air outlet 131 of the motor 130 with fan blades 120 by using the air path switching plate 160. Furthermore, a heater is provided for the wind path at side of the inner warm air outlet 180.

FIG. 2 is a known further type of heating device 190 for bathroom in which heating is achieved by infrared radiation emitted from an infrared ray lamp(s). This type of heater does not have function of circulating air. The heater has four lamps arrayed downward in its square main body. Compared with the heating ventilator 100 for bathroom that circulates air by configuring a ventilating blower, the heating device 190 for bathroom shows a relatively small and cabinet appearance.

Therefore, in order to mount a heating ventilator 100 for bathroom having function of circulating air towards the bathroom in a bathroom designed to be mounted with the above heating device 190, the frame 110 needs to be configured in substantially same shape as that of the heating device 190.

SUMMARY OF THE INVENTION

The present invention has been made to overcome or alleviate at least one aspect of the above mentioned disadvantages.

An object of the present invention is to provide a heating ventilator 100 for bathroom with high thermal efficiency, which enables smoothly and swimmingly blowing warm air out even if a distance from the inner air inlet to the inner warm air outlet is shortened.

For the above purposes, the present invention provides a heating ventilator for bathroom, comprising: a frame, a motor provided with fan blades, a volute casing, an air path switching plate located at air outlet of the volute casing for switching the wind path at the air outlet of the main body of the ventilator, a heater and a control electric circuit mechanism for operating the above motor provided with fan blades, the air path switching plate and the heater, characterized in that, the air path switching plate and the heater are configured in a separate and overlapping manner in the height direction of the main body of the ventilator, and a fan blade center and a tongue portion of the volute casing are offset from a central line of the main body and located on the same side, and the central line of the main body is horizontally aligned and overlapped with the central line of the air path switching plate and the central line of the heater.

According to the heating ventilator for bathroom, an angle of a corner of the tongue portion of the volute casing is smaller than or within 30 degree.

According to the heating ventilator for bathroom, the length of the air path switching plate along its length direction is equal to that of the heater.

According to the heating ventilator for bathroom, the control electric circuit mechanism is located on a side section outside of the wind path in a side opposite to the tongue portion.

DETAILED DESCRIPTION OF THE EMBODIMENTS

Figure 1:
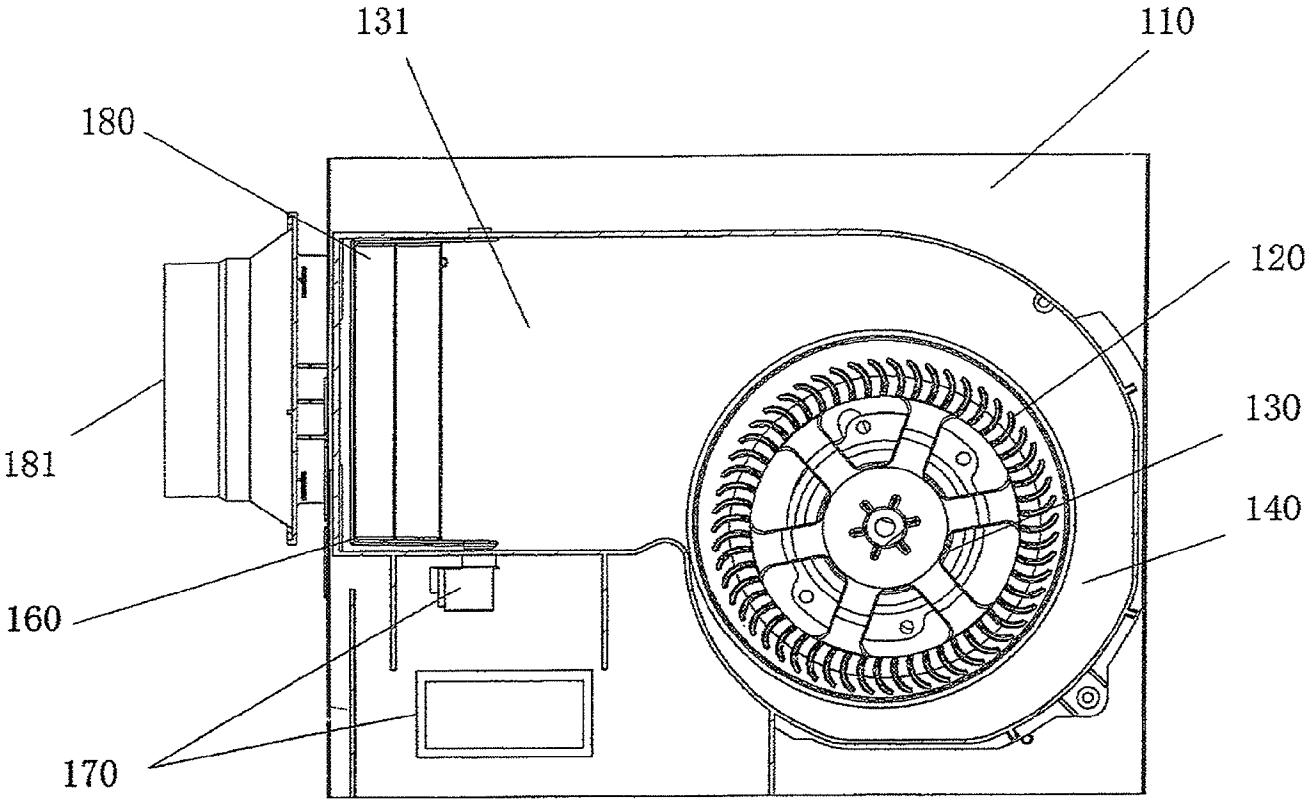
Fig. 1 (Prior Art)
FIG. 1 is a schematic view of a heating ventilator for bathroom of the prior art.
Figure 2:
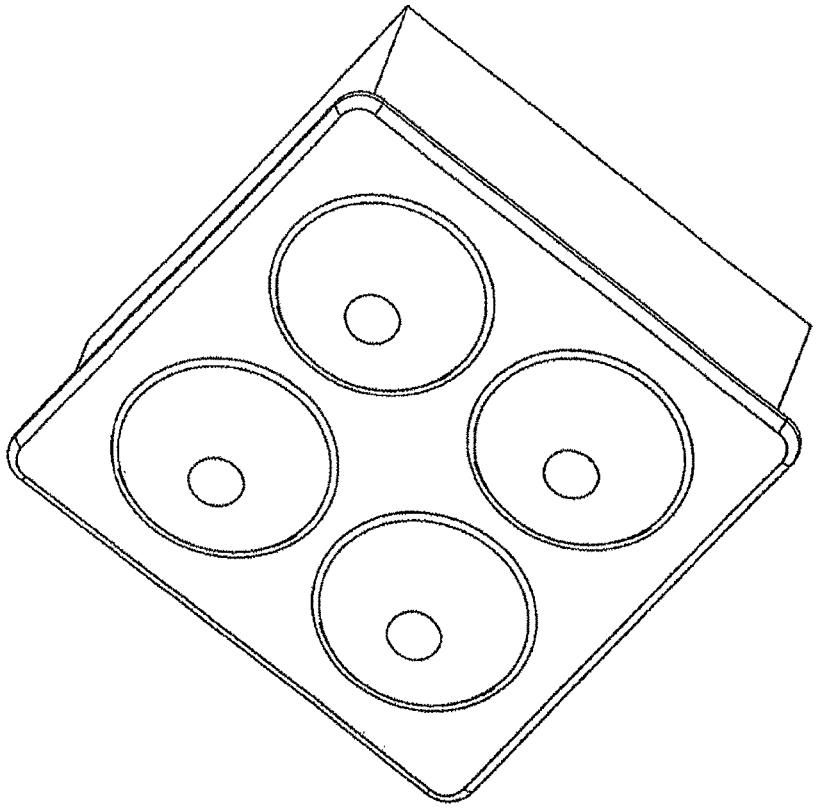
Fig. 2 (Prior Art)
FIG. 2 is a schematic view of a further heating ventilator for bathroom of the prior art.
Figure 3:
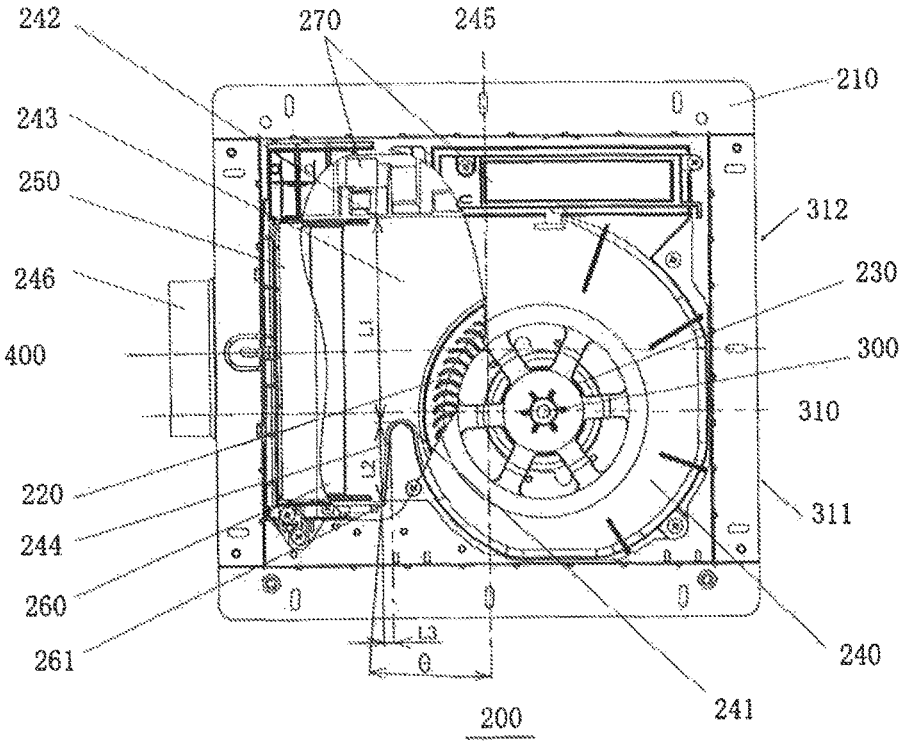
FIG. 3 is an overall schematic view of a cross section of a heating ventilator for bathroom according to the present invention.

FIG. 3 shows schematically an entire cross section of a heating ventilator for bathroom according to the present application. The Figure is a schematic view of the product in plan view.

A heating ventilator 200 for bathroom comprises a frame 210, a motor 230 provided with fan blades 220, a volute casing 240 enclosing the motor 230, an air path switching plate 260 located at air outlet 243 of the volute casing 240 for switching a wind path at the air outlet of the main body of the ventilator, a heater 250 located in a wind path in one direction switched by the above air path switching plate 260, and a control electric circuit mechanism 270 for operating the above motor 230, the air path switching plate 260 and the heater 250.

Figure 4:
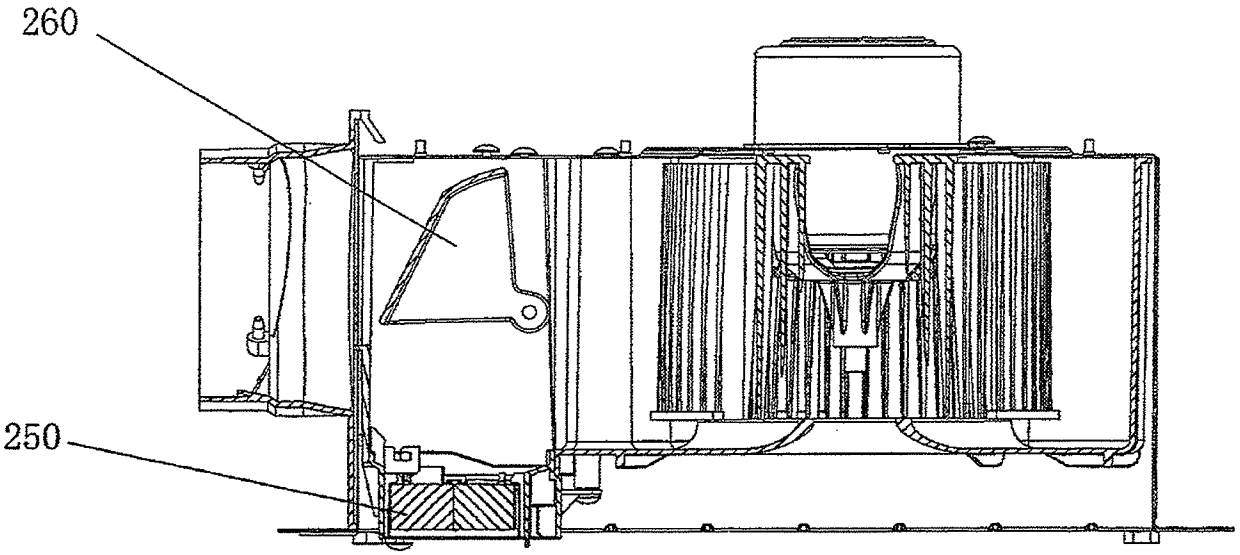
FIG. 4 is a schematic view of positions of the heater and air path switching plate according to the present invention.

As shown in FIG. 4, it is a schematic view of positions of the heater and the air path switching plate. The air path switching plate 260 and the heater 250 are configured in a separate and overlapping manner in the height direction of the main body of the ventilator.

Referring to FIG. 3 again, fan blade center 300 and a tongue portion 241 of the volute casing 240 are both offset from a central line 400 of the main body and located at the same side, and the central line 400 of the main body is horizontally aligned and overlapped with the central line of the air path switching plate 260 and the central line of the heater 250. The center line 400 of the main body refers to a central line of the outside profile of the main body of the frame 210.

Since fan blade center 300 and a tongue portion 241 of the volute casing 240 both are offset from a central line 400 of the main body and locate at the same side, a distance L1 from the tongue portion 241 to top 242 of the outlet 243 of the volute casing 240 may be designed to be much longer while a distance L3 from a distal end 244 of the tongue portion 241 to end 261 of the air path switching plate 260 may be configured to be much shorter. That is, when the air path switching plate 260 corresponds to the outlet 243 of the volute casing 240, the ratio of the length of the air path switching plate 260 corresponding to L1 is big. By comparison, the remaining length of the air path switching plate 260 L2 other than the length corresponding to L1 takes a small proportion, leading to enlarge the air path switching plate 260 and the air outlet 243 of the volute casing 240 and homogenizing the wind amount in upper region and lower region with respect to the tongue portion 241.

Furthermore, since the central line 400 of the main body is horizontally aligned and overlapped with the central line of the air path switching plate 260 and the central line of the heater 250, the air path switching plate 260 and the heater 250 may be located at the center of the main body of the frame 210. That is, the air path switching plate 260 and the heater 250 may be extended towards either end to its uppermost extent from the center of the main body of the frame 210. Further, in the wind path having a rectangle-shaped cross section which is formed by the air path switching plate 260 and the heater 250 and extended from the center of the main body towards two ends, the length of the wind path of the air path switching plate 260 along its length direction is equal to that of the heater 250. Accordingly, air out from the air outlet 243 of the volute casing 240, after passing through the wind path of the air path switching plate 260, is guided to pass through the heater directly without being compressed or expanded. As a result, uniform speed of the wind is achieved.

With the above configuration, the frame 210 can also be configured to be generally a square-shaped product, in which a joint 246 of the air outlet of the frame 210 may be located at the center of outside of the frame. At this way, the frame 210 may be configured to be a square shape, which can be easily mounted even in a bathroom designed for mounting an existing heating ventilator 100 for bathroom in prior art. In addition, the square frame may be rotated by 90 degree as required in actual circumstances to enable discharging wind in four different directions. Therefore, it ensures a smooth wind path and contributes to thermal efficiency even the distance between the inner air inlet and the inner warm air outlet would be shortened.

The angle of a corner β of the tongue portion 241 of the volute casing 240 is smaller than or within 30 degree. As shown in FIG. 3, the corner β of the tongue portion 241 is an angle formed by a wind path sidewall between the wind path of the tongue portion 241 and the end 261 of the air path switching plate 260 and a longitudinal axis 245 of the main body of the ventilator, as viewed in plan view. With the above configuration, a distance from the air outlet 243 to the fan blade center 300 becomes small, thereby efficiently utilizing the inner space of the frame 210 and further miniaturizing the structure, improving installation performance of the product and realizing convenience for mounting.

The control electric circuit mechanism 270 is located on a side outside of the wind path in a side opposite to the tongue portion 312. The term of "a tongue portion side 311" and "a side 312 opposite to the tongue portion 241" refer to respectively a part having the tongue portion 241 and the other part having no the tongue portion 241 of the main body of the ventilator divided by the transverse central line 310 of the fan blade 220. With the above configuration, the control electric circuit mechanism 270 and the air path switching plate 260 are located in a "L" way on a side outside of the wind path in the side 312 opposite to the tongue portion 241. In this way, a space in the volute casing 240 at lower side of the tongue portion 241 may be used for mounting position of the air path switching plate 260 such that its mounting position is consistent with that of the heater 250. Meanwhile, on the side of the control electric circuit mechanism 270, a leading wire protrusion of the heater 250 and actuating devices, such as a control motor for the air path switching plate 260 and a wireless signal receiver, etc. can be mounted. Since the actuating devices are mounted on the side of the control electric circuit mechanism 270, the leading wire may be shortened, thereby saving cost, facilitating assembling of the product and miniaturizing the construction of the product, which is easy to be mounted.

What is claimed is:

1. A heating ventilator for bathroom, comprising:

a frame, a motor provided with fan blades, a volute casing, an air path switching plate located at air outlet of the volute casing for switching the air outlet of the main body of the ventilator, a heater and a control electric circuit mechanism for operating the above motor provided with fan blades, the air path switching plate and the heater, wherein the air path switching plate and the heater are configured in a separate and overlapping manner in the height direction of the main body of the ventilator, a fan blade center and a tongue portion of the volute casing are both offset from a central line of the main body and are both located on the same side of the central line, and the central line of the main body is horizontally aligned and overlapped with the central line of the air path switching plate and the central line of the heater, the control electric circuit mechanism is located on a side section outside of the wind path in a side of the main body of the ventilator opposite to the tongue portion, the control electric circuit mechanism and the air path switching plate are located in an L-shaped arrangement such that the air path switching plate is arranged at a lower side of the tongue portion and the control electric circuit mechanism is arranged at an upper side relative to the tongue portion, and a leading wire protrusion of the heater, a control motor for the air path switching plate, and a wireless signal receiver are mounted on a side of the control electric circuit mechanism.

2. The heating ventilator for bathroom as claim 1, wherein an angle of a corner of the tongue portion of the volute casing is less than 30 degrees and greater than zero degrees.

3. The heating ventilator for bathroom as claim 1, wherein the length of the air path switching plate along its length direction is equal to that of the heater.

* * * * *